US008967128B2

(12) United States Patent
Bellis

(10) Patent No.: US 8,967,128 B2
(45) Date of Patent: Mar. 3, 2015

(54) MULTIPLE LAYER BYPASS HYDROCARBON TRAP

(71) Applicant: Ford Global Technologies, LLC, Dearborn, MI (US)

(72) Inventor: Andrew George Bellis, Plymouth, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 13/908,001

(22) Filed: Jun. 3, 2013

(65) Prior Publication Data

US 2014/0352674 A1 Dec. 4, 2014

(51) Int. Cl.

| | |
|---|---|
| ***F02B 25/06*** | (2006.01) |
| ***F01M 13/04*** | (2006.01) |
| ***F02M 35/024*** | (2006.01) |
| ***F02M 35/10*** | (2006.01) |
| ***F02M 33/04*** | (2006.01) |
| *F02M 35/08* | (2006.01) |

(52) U.S. Cl.

CPC ..... *F01M 13/04* (2013.01); *F02M 35/024* (2013.01); *F02M 35/10281* (2013.01); *F02M 33/043* (2013.01); *F02M 35/088* (2013.01)

USPC ..... 123/573; 123/516; 123/593; 123/434

(58) Field of Classification Search

CPC . F02M 35/02; F02M 35/024; F02M 25/0854; F02M 35/10013; B01D 2257/702; F01M 13/04

USPC ..... 123/572, 573, 593, 574, 575, 518, 519, 123/516, 198 E, 434

See application file for complete search history.

(56) References Cited

U.S. PATENT DOCUMENTS

| | | | | |
|---|---|---|---|---|
| 3,082,091 | A * | 3/1963 | Smith et al. | 426/96 |
| 3,092,091 | A * | 6/1963 | Bosley | 123/574 |
| 3,456,635 | A * | 7/1969 | Hervert | 123/519 |
| 4,297,980 | A | 11/1981 | Bellis | |
| 4,864,821 | A * | 9/1989 | Hoch | 60/274 |
| 6,186,128 | B1 * | 2/2001 | Diotte et al. | 123/572 |
| 6,974,490 | B2 * | 12/2005 | Gillingham et al. | 55/486 |

(Continued)

FOREIGN PATENT DOCUMENTS

| | | | |
|---|---|---|---|
| EP | 1359313 | B1 | 3/2008 |
| GB | 2398750 | A | 9/2004 |
| WO | 2007061893 | A1 | 5/2007 |

*Primary Examiner* — Noah Kamen
*Assistant Examiner* — Long T Tran
(74) *Attorney, Agent, or Firm* — Julia J. Voutyras; Brooks Kushman P.C.

(57) ABSTRACT

An air induction system for an engine includes an air filter box configured to receive an air filter that separates the air filter box into an atmosphere side and a filtered air side, a clean-air duct coupled downstream from the air filter box and upstream of the engine relative to a direction of air flow during engine operation, a flow-through hydrocarbon trap positioned within the clean-air duct, and a bypass hydrocarbon trap secured within the air filter box on the filtered air side, the hydrocarbon trap having a plurality of generally flat or coiled layers of hydrocarbon adsorbing material sandwiched together and secured one to another. Mechanical fasteners such as grommets may extend through the plurality of layers to secure the layers together. The fasteners may be secured to ribs extending along an upper surface of the air filter box or an interior surface of the clean-air duct.

20 Claims, 5 Drawing Sheets

(56) References Cited

U.S. PATENT DOCUMENTS

| | | | | |
|---|---|---|---|---|
| 7,458,366 | B2 | 12/2008 | Luley | |
| 7,578,285 | B2 | 8/2009 | Buelow | |
| 7,677,226 | B2 | 3/2010 | Buelow | |
| 8,413,433 | B2 * | 4/2013 | Lupescu | 60/299 |
| 2002/0043156 | A1 * | 4/2002 | Shea | 96/134 |
| 2004/0211320 | A1 | 10/2004 | Cain | |
| 2005/0183405 | A1 * | 8/2005 | Gillingham et al. | 55/486 |
| 2006/0123991 | A1 * | 6/2006 | Braeunling et al. | 96/153 |
| 2006/0196359 | A1 * | 9/2006 | Gillingham et al. | 95/273 |
| 2007/0107701 | A1 | 5/2007 | Buelow | |
| 2009/0199524 | A1 * | 8/2009 | Gillingham et al. | 55/486 |
| 2009/0272361 | A1 | 11/2009 | Buelow | |
| 2010/0065030 | A1 * | 3/2010 | Bellis | 123/574 |
| 2010/0089341 | A1 * | 4/2010 | Richardson et al. | 123/3 |
| 2010/0089372 | A1 * | 4/2010 | Bellis et al. | 123/573 |
| 2011/0023719 | A1 * | 2/2011 | Kidman et al. | 96/136 |
| 2011/0047986 | A1 * | 3/2011 | Drasner et al. | 60/286 |

* cited by examiner

MULTIPLE LAYER BYPASS HYDROCARBON TRAP

TECHNICAL FIELD

The present disclosure relates to a multiple layer hydrocarbon trap, such as may be used in an air induction system of a vehicle to reduce or eliminate evaporative hydrocarbon emissions.

BACKGROUND

When an internal combustion engine is shut off, unburned hydrocarbon fuel vapors may be left in the air induction system, engine cylinders, engine crankcase, etc. These hydrocarbon fuel vapors may migrate out of the engine cylinders through an open intake valve into the intake manifold along with vapors that have migrated from a crankcase to the intake manifold through a PCV (Positive Crankcase Ventilation) system. After the engine is shut off, the vapors may travel through the fresh air intake system and into the surrounding atmosphere. Further, vapors may also migrate from a crankcase, through a crankcase fresh air hose, to the fresh air intake system and then out into the surrounding atmosphere. Changes in ambient air temperatures may further encourage hydrocarbon fuel vapors to migrate from the vehicle.

To reduce the escape of hydrocarbon vapors from the engine air induction system (AIS), some vehicles include a hydrocarbon trap in the AIS having one or more hydrocarbon adsorbing surfaces to adsorb vaporized hydrocarbons during engine off soaks. These AIS hydrocarbon traps may be periodically purged of the temporarily stored hydrocarbon vapors when the engine is restarted and the vapors are inducted into the cylinders along with fresh air and consumed during normal engine combustion.

A flow-through hydrocarbon trap is positioned such that substantially all the vapors emanating from inside the engine during engine off soaks must pass through it before reaching atmosphere. A bypass hydrocarbon trap is also positioned in the vapor flow path, but only a portion of the vapors pass by or through it prior to reaching atmosphere. Although the flow-through trap is generally more efficient at reducing the amount of hydrocarbon vapors emitted to the environment, a bypass trap may be used to further reduce the escape of any vapors that pass through the flow-through trap, or that may bypass the flow-through trap based on the design of the AIS for some applications. A bypass trap may be used alone or in combination with one or more flow-through traps and/or bypass traps.

Various types of AIS flow through and/or bypass hydrocarbon traps are described in commonly owned U.S. Pat. Nos. 8,191,539; 7,458,366; and 6,905,536, for example. While suitable for various applications, these approaches may require a unique design for each application. Unique designs require additional engineering and development resources and fail to leverage available economies of scale afforded by a design that is more easily adapted to multiple applications. For example, previous designs may require different dimensions for different applications. Similarly, considerations relative to the engine volume may require more or less absorber channel openings. Many prior AIS hydrocarbon traps are difficult to scale and/or package within a vehicle due to space limitations and size and material constraints.

SUMMARY

An air induction system for an engine includes an air filter box configured to receive an air filter that separates the air filter box into an atmosphere side and a filtered air side, a clean-air duct coupled downstream from the air filter box and upstream of the engine relative to a direction of air flow during engine operation, a flow-through hydrocarbon trap positioned within the clean-air duct, and a bypass hydrocarbon trap secured within the air filter box on the filtered air side and adjacent to airflow through the air filter box, the hydrocarbon trap having a plurality of generally flat layers of hydrocarbon adsorbing material sandwiched together and secured one to another.

In various embodiments, the bypass hydrocarbon trap comprises a plurality of grommets each extending through the plurality of generally flat layers of hydrocarbon adsorbing material to secure the layers one to another. The grommets may be secured to ribs extending along an interior upper surface of the air filter box and may be heat staked to the interior of the air filter box. In one embodiment, the plurality of generally flat layers of hydrocarbon adsorbing material are adhesively secured to each other. In another embodiment, a generally flat carbon adsorbing material is formed into a multiple-layer spiral secured by a grommet extending through at least two layers. The grommet is secured to an interior portion of the air induction system of the vehicle.

Embodiments according to the present disclosure may also include an air induction system hydrocarbon trap for a vehicle having a housing adapted to be coupled to the air induction system and a plurality of layers of hydrocarbon adsorbing material sandwiched together and secured one to another to form a single adsorbing assembly, the single adsorbing assembly being secured within the housing such that airflow through the housing passes by the single adsorbing assembly. In one embodiment, a plurality of grommets each extending through the plurality of generally flat layers of hydrocarbon adsorbing material secure the layers one to another and form a single adsorbing assembly. The single adsorbing assembly may be secured to an upper interior surface of the housing. The housing may be configured to accept a flow-through air filter that separates the housing into an atmosphere side and a filtered air side, with the air induction system further including a clean-air duct coupled between the housing and an engine of the vehicle and a flow-through hydrocarbon trap positioned within the clean-air duct.

A hydrocarbon trap disposed within an air induction system of a vehicle according to various embodiments of the present disclosure includes a plurality of generally flat layers of hydrocarbon adsorbing material sandwiched together and mechanically secured one to another by a plurality of grommets passing through the plurality of generally flat layers to form a single adsorbing assembly for being secured to ribs extending from an upper interior surface of an air box of the air induction system.

Various embodiments according to the present disclosure may provide one or more advantages. For example, a multiple layer hydrocarbon trap according to embodiments of the present disclosure may include multiple layers of generally flat polygonal sheets secured together by a plurality of grommets or similar fasteners that may be secured to the clean side of an air box cover. This construction method allows the bundle to be manufactured separately and subsequently assembled to the cover allowing for a more flexible manufacturing process. Of course alternate methods of assembling the bundle may be provided. A multiple layer hydrocarbon trap according to various embodiments of the present disclosure provides a modular solution that can be easily adapted to multiple applications by selecting the number of layers of adsorbing material without changes to the packaging. Embodiments according to the present disclosure may reduce cost by providing a universal design that results in higher volumes. Similarly, a generally flat rectangular or polygonal shape reduces scrap in adsorbing material cutting. A hydrocarbon trap having a universal design according to embodiments of the present disclosure may also reduce engineering costs and time to market. In addition, a universal design according to embodiments of the present disclosure allows for usage of adsorbing material from various vendors and facilitates competitive bidding to further reduce costs.

The above advantages and other advantages and features will be readily apparent from the following detailed description of the preferred embodiments when taken in connection with the accompanying drawings

DETAILED DESCRIPTION

As required, detailed embodiments of the present disclosure are described herein; however, it is to be understood that the disclosed embodiments are merely exemplary and may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

A multiple layer AIS hydrocarbon trap and related methods and systems are described herein. The multiple layer AIS hydrocarbon trap may be integrated into an engine of an automotive vehicle, for example. A representative application of a bypass AIS hydrocarbon trap is described and illustrated with respect to FIGS. 1 and 2.

Figure 1:
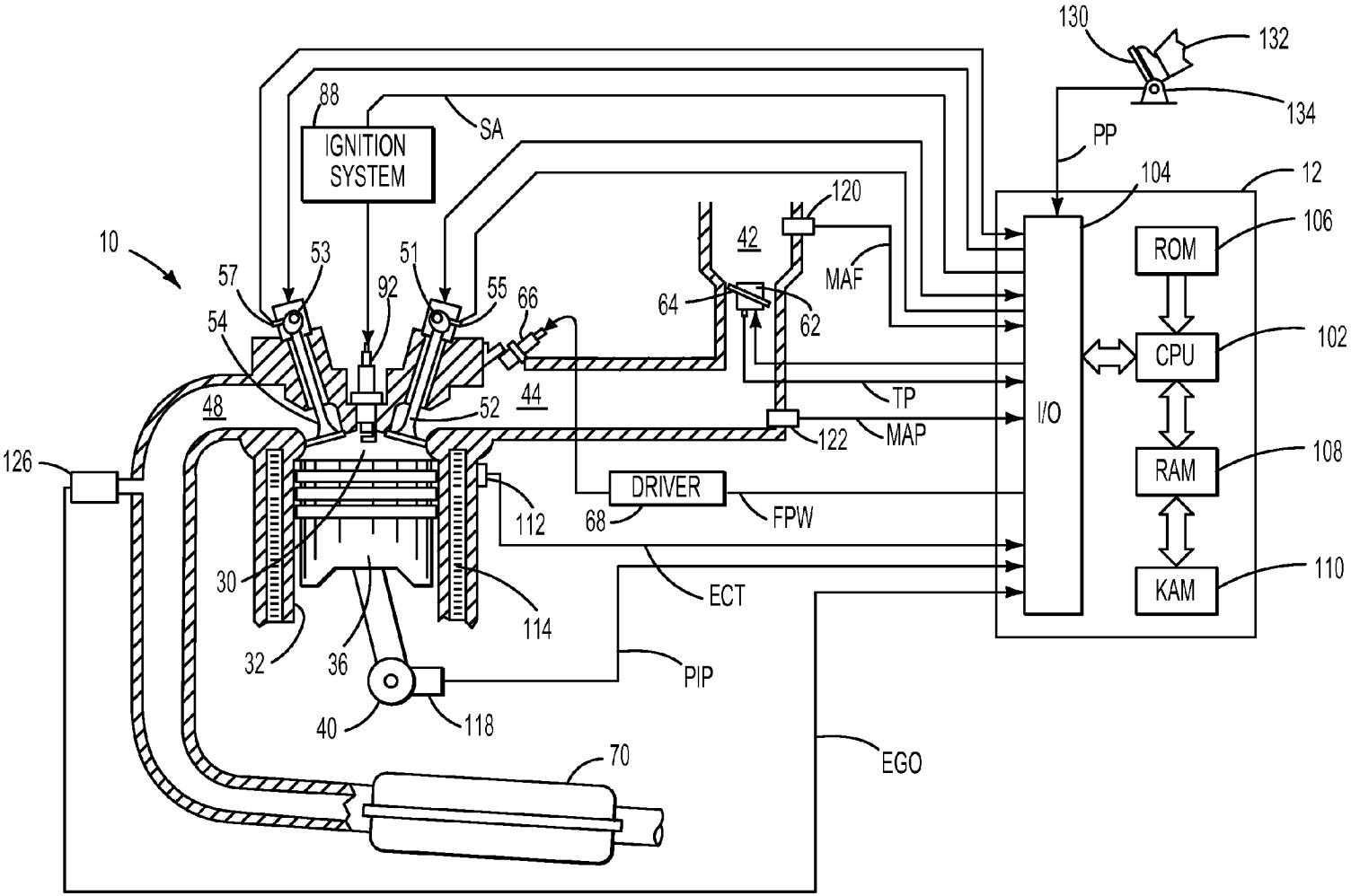
FIG. 1 is a diagram illustrating a representative vehicle application for a multiple layer bypass hydrocarbon trap according to embodiments of the present disclosure.

FIG. 1 is a schematic diagram showing one cylinder of multi-cylinder engine 10, which may be included in a propulsion system of an automobile. While a conventional powertrain arrangement is illustrated, a multiple layer hydrocarbon trap according to embodiments of the present disclosure may also be used in a hybrid vehicle having an engine in combination with a traction battery and one or more electrical machines to propel the vehicle. Engine 10 may be controlled at least partially by a control system including controller 12 and by input from a vehicle operator 132 via an input device 130. In this example, input device 130 includes an accelerator pedal and a pedal position sensor 134 for generating a corresponding pedal position signal PP. Combustion chamber (i.e. cylinder) 30 of engine 10 may include combustion chamber walls 32 with piston 36 positioned therein. Piston 36 may be coupled to crankshaft 40 so that reciprocating motion of the piston is translated into rotational motion of the crankshaft. Crankshaft 40 may be coupled to at least one drive wheel of a vehicle via an intermediate transmission system. Further, a starter motor (or electrical machine in hybrid applications) may be coupled to crankshaft 40 via a flywheel to enable a starting operation of engine 10.

Figure 2:
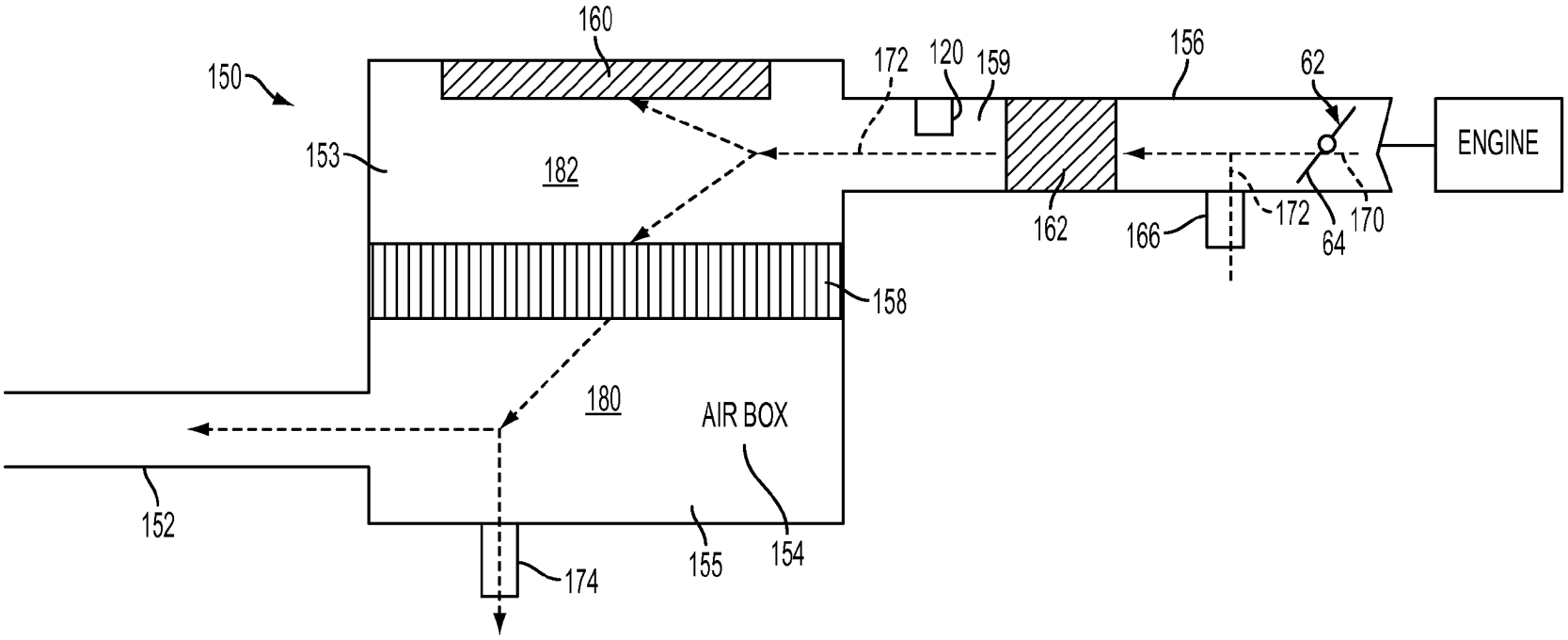
FIG. 2 is a diagram illustrating a vehicle air induction system (AIS) having bypass and flow-through hydrocarbon traps according to one embodiment of the present disclosure and shows the flow of hydrocarbon vapors during engine off soaks.

Combustion chamber 30 may receive intake air from an air induction system having one or more hydrocarbon traps according to the present disclosure as illustrated in greater detail in FIG. 2. The air induction system generally includes an intake manifold 44 and intake passage 42. Combustion chamber 30 may exhaust combustion gases via exhaust passage 48. Intake manifold 44 and exhaust passage 48 can selectively communicate with combustion chamber 30 via respective intake valve 52 and exhaust valve 54. In some embodiments, combustion chamber 30 may include two or more intake valves and/or two or more exhaust valves. In further examples, the intake manifold may selectively communicate with a PCV (Positive Crankcase Ventilation) system via a PCV valve. The PCV system may allow combusted gases that leak or migrate past the rings of piston 36 into the crankcase as blow-by to be vented into the intake manifold.

In this example, intake valve 52 and exhaust valves 54 may be controlled by cam actuation via respective cam actuation systems 51 and 53. Cam actuation systems 51 and 53 may each include one or more cams and may utilize one or more of cam profile switching (CPS), variable cam timing (VCT), variable valve timing (VVT) and/or variable valve lift (VVL) systems that may be operated by controller 12 to vary valve operation. The position of intake valve 52 and exhaust valve 54 may be determined by position sensors 55 and 57, respectively. In alternative embodiments, intake valve 52 and/or exhaust valve 54 may be controlled by electric valve actuation. For example, cylinder 30 may alternatively include an intake valve controlled via electric valve actuation and an exhaust valve controlled via cam actuation including CPS and/or VCT systems.

Fuel injector 66 is shown arranged in intake passage 44 in a configuration that provides what is known as port injection of fuel into the intake port upstream of combustion chamber 30. Fuel injector 66 may inject fuel in proportion to the pulse width of signal FPW received from controller 12 via electronic driver 68. Fuel may be delivered to fuel injector 66 by a fuel system (not shown) including a fuel tank, a fuel pump, and a fuel rail. In some embodiments, combustion chamber 30 may alternatively or additionally include a fuel injector coupled directly to combustion chamber 30 for injecting fuel directly therein, in a manner known as direct injection.

Intake passage 42 may include a throttle 62 having a throttle plate 64. In this particular example, the position of throttle plate 64 may be varied by controller 12 via a signal provided to an electric motor or actuator included with throttle 62, a configuration that is commonly referred to as electronic throttle control (ETC). In this manner, throttle 62 may be operated to vary the intake air provided to combustion chamber 30 among other engine cylinders. The position of throttle plate 64 may be provided to controller 12 by throttle position signal TP. Intake passage 42 may include a mass air flow sensor 120 and a manifold air pressure sensor 122 for providing respective signals MAF and MAP to controller 12. In further examples, the intake passage 42 may be included as part of an air intake system which may feature an air filter and/or one or more AIS hydrocarbon traps as described herein.

Ignition system 88 can provide an ignition spark to combustion chamber 30 via spark plug 92 in response to spark advance signal SA from controller 12, under select operating modes. Though spark ignition components are shown, in some embodiments, combustion chamber 30 or one or more other combustion chambers of engine 10 may be operated in a compression ignition mode, with or without an ignition spark.

Exhaust gas sensor 126 is shown coupled to exhaust passage 48 upstream of emission control device 70. Sensor 126 may be any suitable sensor for providing an indication of exhaust gas air/fuel ratio such as a linear oxygen sensor or UEGO (universal or wide-range exhaust gas oxygen), a two-state oxygen sensor or EGO, a HEGO (heated EGO), a NOx, HC, or CO sensor. Emission control device 70 is shown arranged along exhaust passage 48 downstream of exhaust gas sensor 126. Device 70 may be a three way catalyst (TWC) or other emission control device.

Controller 12 is shown in FIG. 1 as a microcomputer, including microprocessor unit 102, input/output ports 104, an electronic storage medium for executable programs and calibration values shown as read only memory chip 106 in this particular example, random access memory 108, keep alive memory 110, and a data bus. Controller 12 may receive various signals from sensors coupled to engine 10, in addition to those signals previously discussed, including measurement of inducted mass air flow (MAF) from mass air flow sensor 120; engine coolant temperature (ECT) from temperature sensor 112 coupled to cooling sleeve 114; a profile ignition pickup signal (PIP) from Hall effect sensor 118 (or other type) coupled to crankshaft 40; throttle position (TP) from a throttle position sensor; and absolute manifold pressure signal, MAP, from sensor 122. Engine speed signal, RPM, may be generated by controller 12 from signal PIP. Manifold pressure signal MAP from a manifold pressure sensor may be used to provide an indication of vacuum, or pressure, in the intake manifold. Note that various combinations of the above sensors may be used, such as a MAF sensor without a MAP sensor, or vice versa. Storage medium read-only memory 106 can be programmed with computer readable data representing instructions executable by processor 102 for performing various engine and/or vehicle control methods.

FIG. 2 provides a schematic illustration of an example air intake system 150 including at least one hydrocarbon trap. As described in more detail below, in one embodiment, a bypass hydrocarbon trap 160 includes a plurality of generally flat layers of hydrocarbon adsorbing material sandwiched together and secured one to another by a plurality of grommets passing through the plurality of generally flat layers to form a single adsorbing assembly for being secured to ribs extending from an upper interior surface of an air box 154 of the air induction system. Further, as described in more detail below, the trap 160 may be permanently secured within air box 154 using tamper evident fasteners, such as by heat staking, for example, to operate as a passive emissions control device that does not require monitoring by the on-board diagnostics (OBD) system.

As generally shown in FIG. 2, air intake system 150 may include an atmosphere or dirty air duct 152, an air box 154, and a filtered or clean air duct 156 coupled to the engine. Air box 154 may be configured to accept an air filter 158 that separates air box 154 into an atmosphere or dirty side downstream of air filter 158, and a filtered or clean side upstream of filter 158 between atmosphere and the engine. Air filter 158 may be positioned between an air box cover 153 and an air box tray 155. Air filter 158 may be disposed in air box 154 along with one or more hydrocarbon traps, such as multiple layer bypass hydrocarbon trap 160 and/or a flow-through hydrocarbon trap 162. One or more sensors, such as mass air flow (MAF) sensor 120 may also be disposed in the air intake system as previously described. A PCV fresh air port 166 and throttle 62 may further be disposed in the air intake system. It should be appreciated that in addition to the above ports, the clean air duct may include additional ports, such as a brake aspiration port, a fuel vapor purging port, etc. Note that the flow indicated by the arrows in FIG. 2 represents the vapor flow during engine off periods, which is generally opposite that of the air flow into the engine during engine on/running periods.

As used herein, a flow-through trap is a trap where substantially all the vapors emanating from inside the engine during engine off soaks must pass before reaching the surrounding environment. A bypass trap is a trap positioned in the airflow such that vapors emanating from inside the engine during engine off soaks pass by the trap before reaching the surrounding environment. Although the flow-through trap is generally more efficient at reducing the amount of hydrocarbon vapors emitted to the environment, the bypass trap also does reduce the release of such vapors and may be used alone or in combination with one or more flow-through traps and/or bypass traps. Although generally described herein as a bypass trap, it should be appreciated that the multiple layer hydrocarbon trap as disclosed may also be used as a flow-through hydrocarbon trap.

During engine off, evaporative emissions may migrate or diffuse through the air intake system. The escape of the hydrocarbons from the air induction system may result in hydrocarbons being released into the surrounding environment. For example, the unburned hydrocarbon fuel vapors may migrate from the engine as indicated at 170 or from the PCV fresh air port 166, (flow indicated at 172) back through the flow through hydrocarbon trap 162 and/or the bypass hydrocarbon trap 160. Non-adsorbed emissions may flow through air box 154, dirty air duct 152, and/or water drain 174. By using a multiple layer hydrocarbon trap as described herein, the amount of hydrocarbons released to the surrounding environment or atmosphere can be substantially reduced or eliminated.

As described in more detail below, the hydrocarbon trap is described as an adsorbing trap, such that the trap is adapted to collect and adhere hydrocarbon gases, such as the "light ends" of gasoline, on the surface of the adsorbing material in the trap. These "light ends" of gasoline have been found to be one of the primary constituents of the vapors emanating from a typical air induction system during engine off soaks. As generally understood by those of ordinary skill in the art, a hydrocarbon trap according to the present disclosure should include material that facilitates adsorption rather than absorption so that the trapped hydrocarbons are more easily released from the material for combustion within the engine during subsequent trap purging cycles.

With continuing reference to FIG. 2, the hydrocarbon trap may be disposed in any suitable location in the air intake or air induction system. For example, as shown, the hydrocarbon trap 160 may be disposed within the air box 154. In the representative embodiment illustrated in FIG. 2, hydrocarbon trap 160 is secured to an upper interior surface of air box 154. The hydrocarbon trap 160 may be secured to interior ribs extending along the upper surface of air box cover 153 as illustrated and described with reference to FIG. 3. Positioning of the hydrocarbon trap 160 in air box cover 153 may depend on whether there is enough space 159 beyond the MAF sensor to accommodate the trap. In other examples, the hydrocarbon trap may be positioned before the MAF sensor 120. In even other examples, where the PCV fresh air port is separate from the main inlet air filtration system, i.e. uses a separate air filtration system, the hydrocarbon trap may be disposed anywhere between MAF sensor 120 and throttle plate 64. In even further examples, a multiple layer hydrocarbon trap 160 may be disposed within the engine intake manifold, a resonator, etc.

As shown in FIG. 2, a representative embodiment of an air induction system for an engine/vehicle includes an air filter box or housing 154 configured to receive an air filter 158 that separates the air filter box into an atmosphere side 180 and a filtered air side 182. A clean-air duct 156 coupled downstream from air filter box 155 and upstream of the engine relative to a direction of air flow during engine operation. A flow-through hydrocarbon trap 162 is positioned within the clean-air duct 158. A bypass hydrocarbon trap 160 is secured within the air filter box 154 on the filtered air side 182 and adjacent to airflow 172 through air filter box 154. Hydrocarbon trap 160 includes a plurality of generally flat layers (best illustrated in FIG. 4) of hydrocarbon adsorbing material sandwiched together and secured one to another.

Figure 3:
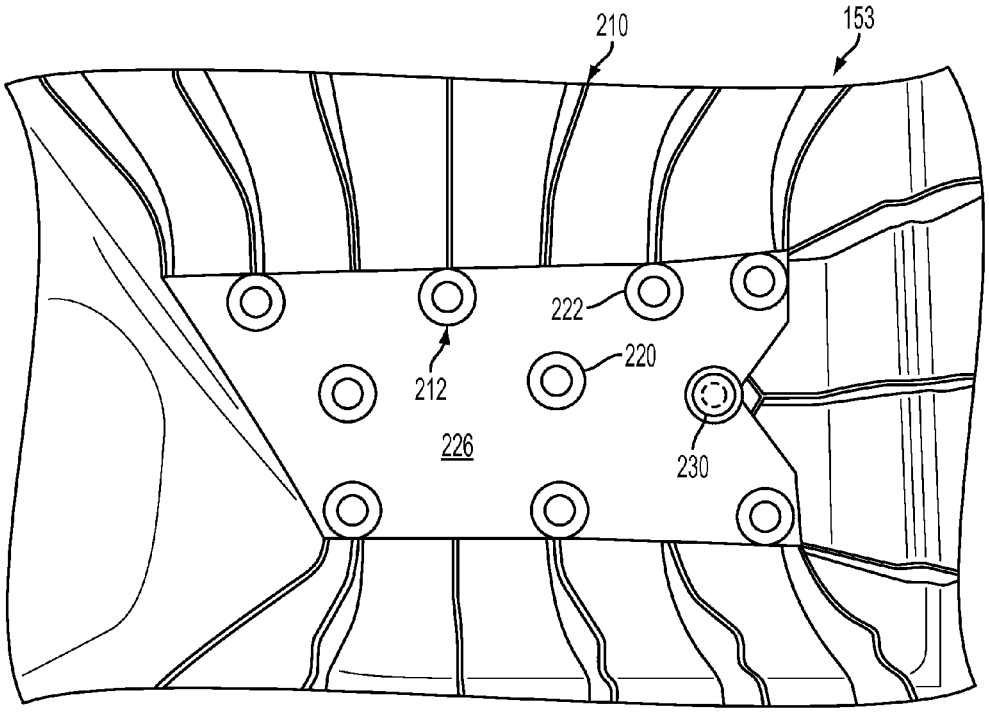
FIG. 3 illustrates a representative air box having a multiple layer hydrocarbon trap according to one embodiment of the present disclosure.
Figure 4:
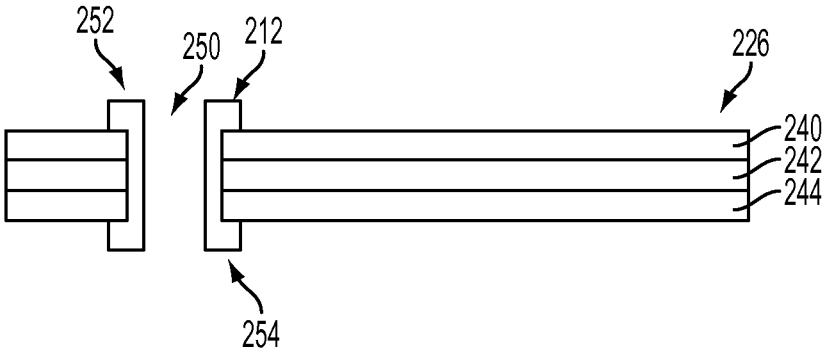
FIG. 4 is a partial cross-sectional view of a multiple layer hydrocarbon trap according to one embodiment of the present disclosure.

FIG. 3 illustrates a representative air box cover having a multiple layer hydrocarbon trap secured to ribs extending along an upper interior surface of the air box cover according to one embodiment of the present disclosure. FIG. 4 is a partial cross-sectional view of a multiple layer hydrocarbon trap according to one embodiment of the present disclosure, and FIG. 5 is a top view of the embodiment of FIG. 4.

Figure 5:
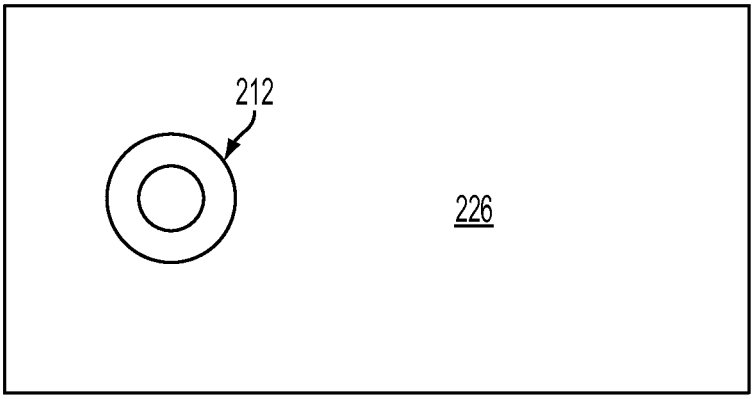
FIG. 5 is a top view of the embodiment of FIG. 4.

As illustrated in FIGS. 3-5, multiple layer hydrocarbon trap 226 includes a plurality of mechanical fasteners 212. In the representative embodiment illustrated, mechanical fasteners 212 are implemented by grommets generally represented by grommets 220 and 222 each having a through hole 250, an upper flange 252, and a lower flange 254. Grommets or other mechanical fasteners extend through a plurality of layers 240, 242, 244 of generally flat sheets of hydrocarbon adsorbing material that are sandwiched together. Grommets 220, 222 or other mechanical fasteners extending through the multiple layers 240, 242, 244 may be positioned based on the particular application to secure the layers one to another to form a single adsorbing assembly or sub-assembly to facilitate ease of assembly into air box cover 153. Grommets or other mechanical fasteners 212 may also be used to secure the single adsorbing sub-assembly within air box cover 153.

In one embodiment, air box cover 153 includes a plurality of ribs 210 extending along an upper surface (as installed in a vehicle) and along sides of the air box to provide structural support for the air box, which may be made of plastic, for example. One or more grommets 222 may be aligned with and/or secured to an associated rib 210. In one embodiment, air box cover 153 includes a plurality of alignment pins 230 that extend through associated grommets 220 to position the hydrocarbon adsorbing sub-assembly within air box cover 153. The sub-assembly may be secured to cover 153 by heat staked alignment pins 230 to grommets 222. In other embodiments, multiple layers 240, 242, 244 of generally flat sheets of hydrocarbon adsorbing material are secured one to another by adhesive. Similarly, the hydrocarbon trap material, which may be an adsorbing material such as carbon paper or other material, is secured within cover 153 by adhesive, by ultrasonic welding, a mechanical fastener, such as a screw, or a combination thereof.

As previously described, the number of layers 240-242 may be increased or decreased to provide a desired area or volume of hydrocarbon adsorbing material for a particular application. Various representative embodiments of a bypass hydrocarbon trap according to the present disclosure include five layers or six layers of hydrocarbon adsorbing material with each sheet having a nominal thickness of 0.02850 inches (0.7239 mm) with a combined thickness of about 0.150-0.180 inches (3.81-4.57 mm).

Figure 6:
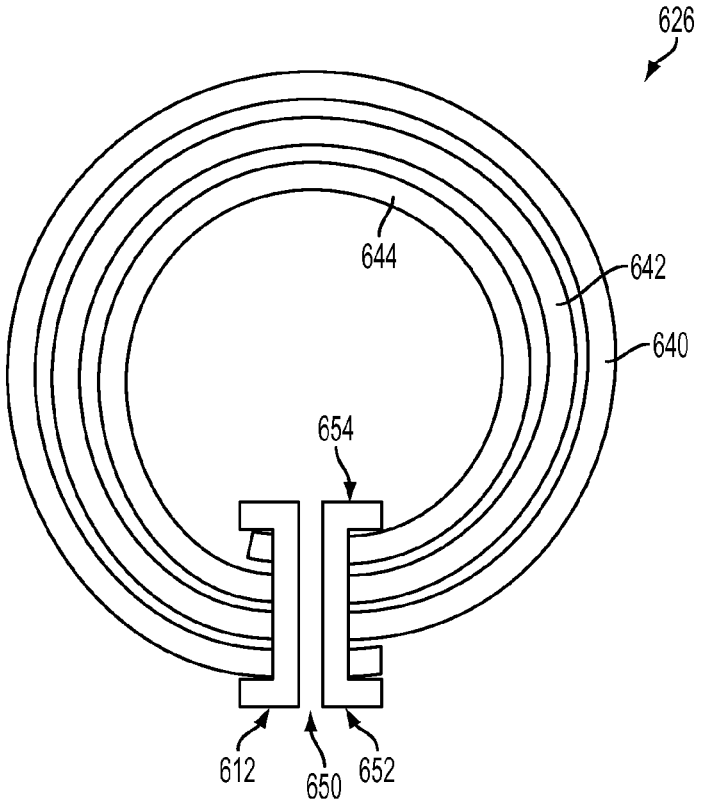
FIGS. 6 and 7 illustrate alternative embodiments of a multiple layer hydrocarbon trap for use as a bypass or flow-through trap according to the present disclosure.
Figure 7:
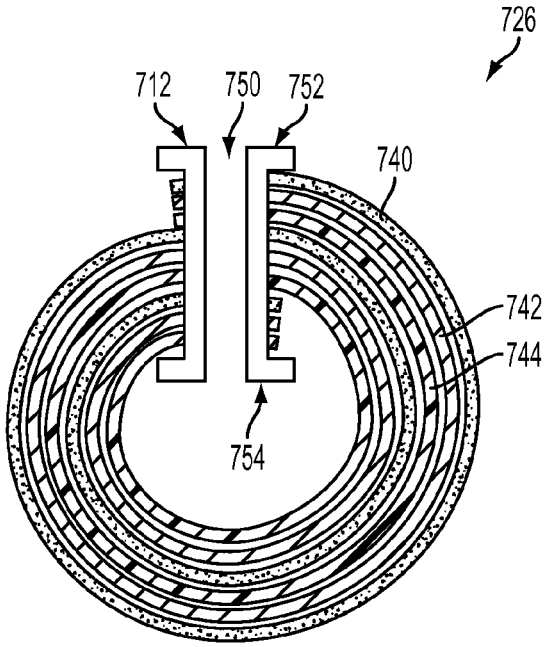

FIGS. 6 and 7 illustrate alternative embodiments of a multiple layer hydrocarbon trap according to the present disclosure. While illustrated as a generally circular coiled arrangement, those of ordinary skill in the art will recognize that the hydrocarbon adsorbing material may be formed into various geometries to fit within an air box, duct, etc. and used as a flow-through or bypass trap depending on the particular application. Similarly, the coiled or otherwise formed embodiments may include a single layer that is formed in a spiral, undulating, or wrapped fashion to create multiple layers as depicted in the embodiment of FIG. 6. Alternatively, multiple layers of the hydrocarbon adsorbing material may first be stacked and then coiled or otherwise formed as generally represented in the embodiment of FIG. 7.

Multiple layer hydrocarbon trap 626 may include a plurality of mechanical fasteners generally represented by fastener 612. In the representative embodiments illustrated in FIGS. 6 and 7, mechanical fasteners 612, 712 are implemented by grommets each having a through hole 650, 750, an upper or outer flange 652, 752, and a lower or inner flange 654, 754. Grommets or other mechanical fasteners extend through at least two layers 640, 642, 644 (or 740, 742, 744) of generally flat sheets of hydrocarbon adsorbing material that are sandwiched together and formed into a desired geometry for an air duct, air box, etc. Grommets 620, 720 or other mechanical fasteners extending through the multiple layers may be positioned based on the particular application to secure the layers one to another to form a single adsorbing assembly or sub-assembly to facilitate ease of assembly into an air box, air duct, or the like. Grommets or other mechanical fasteners may also be used to secure the single adsorbing sub-assembly within the air box, air duct, etc.

As described with respect to the embodiments of FIGS. 2-5, the embodiments of FIGS. 6 and 7 may include one or more grommets aligned with and/or secured to an associated rib, flange, or other structure on an interior of an air box, air duct, etc. The sub-assembly hydrocarbon adsorbing subassembly may be secured to associated structure with in the air induction system by heat staked alignment pins. Multiple layers 640, 642, 644 (or 740, 742, 744) of sheets of hydrocarbon adsorbing material may be secured one to another by adhesive. As previously described, the number of layers may be increased or decreased to provide a desired area or volume of hydrocarbon adsorbing material for a particular application.

As those of ordinary skill in the art will appreciate based on the representative embodiments described above, various embodiments according to the present disclosure may provide advantages such as securing multiple layers of sheets of hydrocarbon adsorbing material together for ease of assembly within an air box cover. This construction method allows the bundle to be manufactured separately and subsequently assembled to the cover allowing for a more flexible manufacturing process. Use of multiple layers of generally flat sheets sandwiched together provides a modular solution that can be easily adapted to multiple applications by selecting the number of layers of adsorbing material without changes to the packaging. Embodiments according to the present disclosure may reduce cost by providing a universal design that results in higher volumes of component pieces, such as the layers of adsorbing material. Similarly, a generally flat rectangular or polygonal shape reduces scrap in adsorbing material cutting. A hydrocarbon trap having a universal design according to embodiments of the present disclosure may also reduce engineering costs and time to market. In addition, a universal design according to embodiments of the present disclosure allows for usage of adsorbing material from various vendors and facilitates competitive bidding to further reduce costs.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention. While various embodiments may have been described as providing advantages or being preferred over other embodiments with respect to one or more desired characteristics, as one skilled in the art is aware, one or more characteristics may be compromised to achieve desired system attributes, which depend on the specific application and implementation. These attributes include, but are not limited to: cost, strength, durability, life cycle cost, marketability, appearance, packaging, size, serviceability, weight, manufacturability, ease of assembly, etc. The embodiments discussed herein that are described as less desirable than other embodiments or prior art implementations with respect to one or more characteristics are not outside the scope of the disclosure and may be desirable for particular applications.

What is claimed is:

1. An air induction system for an engine, comprising:

an air filter box configured to receive an air filter that separates the air filter box into an atmosphere side and a filtered air side;

a clean-air duct coupled downstream from the air filter box and upstream of the engine relative to a direction of air flow during engine operation;

a flow-through hydrocarbon trap positioned within the clean-air duct, the hydrocarbon trap having a plurality of layers of hydrocarbon adsorbing material; and a bypass hydrocarbon trap secured within the air filter box on the filtered air side and adjacent to airflow through the air filter box, the hydrocarbon trap having a plurality of generally flat layers of hydrocarbon adsorbing material sandwiched together and secured one to another.

2. The air induction system of claim 1 wherein at least one of the bypass hydrocarbon trap and the flow-through hydrocarbon trap comprises a plurality of grommets each extending through the plurality of layers of hydrocarbon adsorbing material to secure the layers one to another.

3. The air induction system of claim 2 wherein the grommets are secured to an interior of the air filter box or to an interior of a clean-air duct.

4. The air induction system of claim 3 wherein the grommets are secured to associated ribs on the interior of the air filter box or to the interior of the clean-air duct.

5. The air induction system of claim 3 wherein the grommets are heat staked to the interior of the air filter box or to the interior of a clean-air duct.

6. The air induction system of claim 1 wherein at least one of the bypass hydrocarbon trap and the flow-through hydrocarbon trap is secured to an interior surface of the air filter box or an interior surface of a clean-air duct.

7. The air induction system of claim 1 wherein the bypass hydrocarbon trap is secured to a plurality of ribs within the air filter box.

8. The air induction system of claim 1 wherein the plurality of generally flat layers of hydrocarbon adsorbing material are adhesively secured to each other.

9. The air induction system of claim 1 wherein the plurality of generally flat layers of hydrocarbon adsorbing material are mechanically secured one to another.

10. An air induction system hydrocarbon trap for a vehicle, comprising:

a housing adapted to be coupled to the air induction system; and a plurality of generally flat layers of hydrocarbon adsorbing material sandwiched together and secured one to another to form a single adsorbing assembly, the single adsorbing assembly being secured within the housing such that airflow through the housing passes by the single adsorbing assembly.

11. The air induction system of claim 10 further comprising a plurality of grommets each extending through the plurality of generally flat layers of hydrocarbon adsorbing material to secure the layers one to another and form a single adsorbing assembly.

12. The air induction system of claim 10 wherein the single adsorbing assembly is secured to an upper interior surface of the housing.

13. The air induction system of claim 10 wherein the housing is configured to accept a flow-through air filter that separates the housing into an atmosphere side and a filtered air side, the air induction system further comprising:

a clean-air duct coupled between the housing and an engine of the vehicle; and a flow-through hydrocarbon trap positioned within the clean-air duct.

14. The air induction system of claim 10 wherein the generally flat layers are secured one to another by a mechanical fastener extending through the plurality of layers.

15. The air induction system of claim 10 wherein the single adsorbing assembly is heat staked to an upper interior surface of the housing.

16. The air induction system of claim 10 wherein the single adsorbing assembly is secured to a plurality of ribs within an interior of the housing.

17. A hydrocarbon trap disposed within an air induction system of a vehicle, the trap comprising:

a plurality of generally flat layers of hydrocarbon adsorbing material sandwiched together and mechanically secured one to another by a plurality of grommets passing through the plurality of generally flat layers to form a single adsorbing assembly for being secured to ribs extending from an upper interior surface of an air box of the air induction system.

18. The hydrocarbon trap of claim 17 wherein the grommets are heat staked to the pins of the air box.

19. The hydrocarbon trap of claim 17 wherein the single adsorbing assembly is secured to pins extending from the upper interior surface of the air box through at least some of the plurality of grommets.

20. The hydrocarbon trap of claim 17 wherein the plurality of grommets are spaced about a perimeter of the generally flat layers.

* * * * *